US009713560B1

(12) United States Patent
Raymond et al.

(10) Patent No.: US 9,713,560 B1
(45) Date of Patent: Jul. 25, 2017

(54) WHEELCHAIR WITH A LIFT ASSISTANCE DEVICE

(71) Applicants: Alta Raymond, Concord, NC (US); Jean Raymond, Concord, NC (US)

(72) Inventors: Alta Raymond, Concord, NC (US); Jean Raymond, Concord, NC (US)

( * ) Notice: Subject to any disclaimer, the term of this patent is extended or adjusted under 35 U.S.C. 154(b) by 0 days.

(21) Appl. No.: 14/798,607

(22) Filed: Jul. 14, 2015

(51) Int. Cl.
*A61G 5/10* (2006.01)
*A61G 5/14* (2006.01)

(52) U.S. Cl.
CPC ..... *A61G 5/14* (2013.01); *A61G 5/1059* (2013.01); *A61G 5/104* (2013.01)

(58) Field of Classification Search
CPC ..... A61G 5/08; A61G 5/0825; A61G 5/0841; A61G 5/0858; A61G 5/104; A61G 5/1059; A61G 5/14
USPC ..... 297/330, 344.17, 344.2
See application file for complete search history.

(56) References Cited

U.S. PATENT DOCUMENTS 4,007,959 A * 2/1977 Juergens ..... A61G 5/08 280/42
4,045,051 A * 8/1977 Igarashi ..... A61G 5/08 280/42
4,141,094 A * 2/1979 Ferguson ..... A61G 5/14 280/250.1
4,193,147 A * 3/1980 Fischer ..... A61G 5/006 297/DIG. 4
4,415,177 A * 11/1983 Hale ..... A47C 4/42 280/650
4,431,076 A * 2/1984 Simpson ..... A61G 5/045 280/250.1
4,527,829 A * 7/1985 Fanslau ..... A61G 5/08 297/16.1
4,569,556 A * 2/1986 Pillot ..... A61G 5/14 297/316
4,741,547 A * 5/1988 Tholkes ..... A61G 5/08 280/250.1
4,802,683 A * 2/1989 Gillum, Sr. ..... A61G 5/08 280/250.1
4,860,733 A * 8/1989 Parker, Jr. ..... A61H 1/0292 297/330
4,949,410 A * 8/1990 Failor ..... A61G 5/006 5/425
5,094,508 A * 3/1992 Bathrick ..... A61G 5/14 297/320
5,161,812 A * 11/1992 DeWeese ..... A61G 5/1059 280/47.38
5,375,913 A * 12/1994 Blanchard ..... A61G 5/14 297/310

(Continued)

*Primary Examiner* — Joseph Rocca
*Assistant Examiner* — Maurice Williams
(74) *Attorney, Agent, or Firm* — Stevenson IP, LLC

(57) ABSTRACT

A wheelchair with a lift assistance device including a wheelchair, a scissor lift disposed on the wheelchair, a battery compartment attached to the scissor lift, a rechargeable battery disposed within the battery compartment, a seat portion attached to the scissor lift, an activation control disposed on the wheelchair, and a pair of lift controls. The seat portion has an extended position and an alternate retracted position. The seat portion is in the extended position when the scissor lift is extended above a rear support of a support frame of the wheelchair. The seat portion is in the retracted position when the scissor lift is retracted proximal the rear support of the support frame of the wheelchair.

2 Claims, 6 Drawing Sheets

(56) References Cited

U.S. PATENT DOCUMENTS 5,653,301 A * 8/1997 Andre ..... A61G 5/068 180/8.2
5,695,248 A * 12/1997 Bell ..... A47C 3/30 297/252
5,800,016 A * 9/1998 Allred ..... A61G 5/1059 248/421
6,315,319 B1 * 11/2001 Hanson ..... A61G 5/006 280/250.1
6,454,285 B1 9/2002 Koenig
6,540,250 B1 * 4/2003 Peterson ..... A61G 5/042 280/304.1
6,851,751 B1 2/2005 Romero et al.
6,938,911 B1 * 9/2005 Shyu ..... A61G 5/08 280/250.1
8,360,518 B2 1/2013 Braaten
2003/0011229 A1 * 1/2003 Bell ..... A61G 5/1059 297/344.17
2004/0075237 A1 * 4/2004 Beck ..... A61G 5/1059 280/250.1
2004/0183276 A1 * 9/2004 Silva ..... A61G 5/1059 280/657
2004/0212173 A1 * 10/2004 Wing ..... A61G 5/006 280/304.1
2007/0084648 A1 * 4/2007 DuFresne ..... A61G 5/1059 180/65.1
2007/0235965 A1 * 10/2007 Wu ..... A61G 5/045 280/47.38
2008/0133089 A1 * 6/2008 Bayomy ..... A61G 5/1059 701/49
2010/0148466 A1 * 6/2010 Richter ..... A61G 5/1059 280/250.1
2011/0227314 A1 * 9/2011 Lowenthal ..... A61G 5/1043 280/304.1
2011/0304186 A1 * 12/2011 Andrews ..... A61G 5/1059 297/344.16
2012/0007341 A1 * 1/2012 Masaki ..... A61G 5/08 280/650
2012/0104818 A1 * 5/2012 Morris ..... A61G 5/1059 297/316
2012/0181832 A1 * 7/2012 Lin ..... A61G 5/14 297/330
2013/0341984 A1 * 12/2013 Olesen ..... A61G 5/1059 297/344.15
2014/0265497 A1 * 9/2014 Hough ..... A61G 5/14 297/316
2015/0028643 A1 * 1/2015 Reborse ..... A61G 5/14 297/344.16
2015/0137567 A1 * 5/2015 Smith ..... A61G 5/1059 297/183.1
2015/0202102 A1 * 7/2015 Dunham ..... A61G 5/1059 297/344.13
2015/0250667 A1 * 9/2015 Thompson ..... A61G 5/08 280/650
2015/0272798 A1 * 10/2015 Hsieh ..... A61G 5/14 297/313
2015/0366729 A1 * 12/2015 Quick ..... A61G 5/1059 297/88

* cited by examiner

WHEELCHAIR WITH A LIFT ASSISTANCE DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of wheelchairs are known in the prior art. However, what has been needed is a wheelchair with a lift assistance device including a wheelchair, a scissor lift disposed on the wheelchair, a battery compartment attached to the scissor lift, a rechargeable battery disposed within the battery compartment, a seat portion attached to the scissor lift, an activation control disposed on the wheelchair, and a pair of lift controls. What has been further needed is for the scissor lift to move the seat portion from an extended position to an alternate retracted position. The seat portion is in the extended position when the scissor lift is extended above a rear support of a support frame of the wheelchair. The seat portion is in the retracted position when the scissor lift is retracted proximal the rear support of the support frame of the wheelchair. The wheelchair with a lift assistance device thus provides an operator of a wheelchair with the ability to efficiently lift and transport wheelchair-bound individuals with less physical stress and strain to both parties.

FIELD OF THE INVENTION

The present invention relates to wheelchairs, and more particularly, to a wheelchair with a lift assistance device.

SUMMARY OF THE INVENTION

The general purpose of the present wheelchair with a lift assistance device, described subsequently in greater detail, is to provide a wheelchair which has many novel features that result in a wheelchair with a lift assistance device which is not anticipated, rendered obvious, suggested, or even implied by prior art, either alone or in combination thereof.

To accomplish this, the present wheelchair with a lift assistance device includes a wheelchair, a scissor lift, a battery compartment, a rechargeable battery, a power cord, a seat portion, an activation control, and a pair of lift controls. The wheelchair, which is optionally foldable, has a pair of rear wheels, a pair of front wheels, a pair of footrests, a pair of handles, a pair of armrests, and a support frame. The support frame includes a continuous U-shaped rear support, a pair of bottom supports, and a pair of front vertical supports. The pair of armrests are optionally moveable between a lowered position and an alternate raised position. Each of the pair of armrests is in the lowered position when each of the pair of armrests is disposed parallel to the pair of bottom supports. Each of the pair of armrests is in the raised position when each of the pair of armrests and the pair of bottom supports are perpendicularly disposed.

The rear support of the support frame includes a right vertical support, a left vertical support, and a middle horizontal support. The middle horizontal support has a right end, a left end, a top surface, and a front surface. Each of the right vertical support and the left vertical support has a top end and a bottom end. The bottom end of the right vertical support is attached to the top surface of the middle horizontal support proximal the right end, and the bottom end of the left vertical support is attached to the top surface of the middle horizontal support proximal the left end. Each of the right vertical support and the left vertical support are perpendicularly disposed with the middle horizontal support.

The pair of bottom supports of the support frame includes a right bottom support and a left bottom support. Each of the right bottom support and the left bottom support has a front end, a back end, a top area, and a bottom area. The back end of each of the right bottom support and the left bottom support is attached to the front surface of the middle horizontal support proximal the right end and the left end, respectively. Each of the right bottom support and the left bottom support are perpendicularly disposed with the middle horizontal support.

The pair of front vertical supports of the support frame includes a right front vertical support and a left front vertical support. Each of the right front vertical support and the left front vertical support has a top edge and a bottom edge. The top edge of each of the right front vertical support and the left front vertical support is attached to the bottom area of the right bottom support and the left bottom support, respectively, proximal the front end. The bottom edge of each of the right front vertical support and the left front vertical support is attached to a right front wheel of the pair of front wheels and a left front wheel of the pair of front wheels, respectively. Each of the right front vertical support and the left front vertical support is perpendicularly disposed with the right bottom support and the left bottom support, respectively.

The scissor lift is medially disposed on the top surface of the middle horizontal support between the right vertical support and the left vertical support. The scissor lift has a motor and a hydraulic arm. The hydraulic arm is configured to move the scissor lift between an extended position and an alternate retracted position. The battery compartment is attached to the scissor lift. The rechargeable battery is disposed within the battery compartment. The power cord has a first end and a second end. The first end is removably attached to the rechargeable battery, and the second end is removably attached to a power source.

The seat portion is attached to the scissor lift and removably disposed atop the support frame. The scissor lift is configured to move the seat portion from an extended position to an alternate retracted position. The seat portion is in the extended position when the scissor lift is extended above the rear support of the support frame. The seat portion is in the retracted position when the scissor lift is retracted proximal the rear support of the support frame.

The activation control is disposed on the wheelchair. The activation control is configured to activate the scissor lift. The pair of lift controls include an up control and a down control. The up control is configured to activate the scissor lift to raise the seat portion to the extended position. The down control is configured to activate the scissor lift to lower the seat portion to the retracted position. The rechargeable battery, the power source, the activation control, and the pair of lift controls are in operational communication with each other.

Thus has been broadly outlined the more important features of the present wheelchair with a lift assistance device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 6 thereof, an example of the instant wheelchair with a lift assistance device employing the principles and concepts of the present wheelchair with a lift assistance device and generally designated by the reference number 10 will be described.

Figure 1:
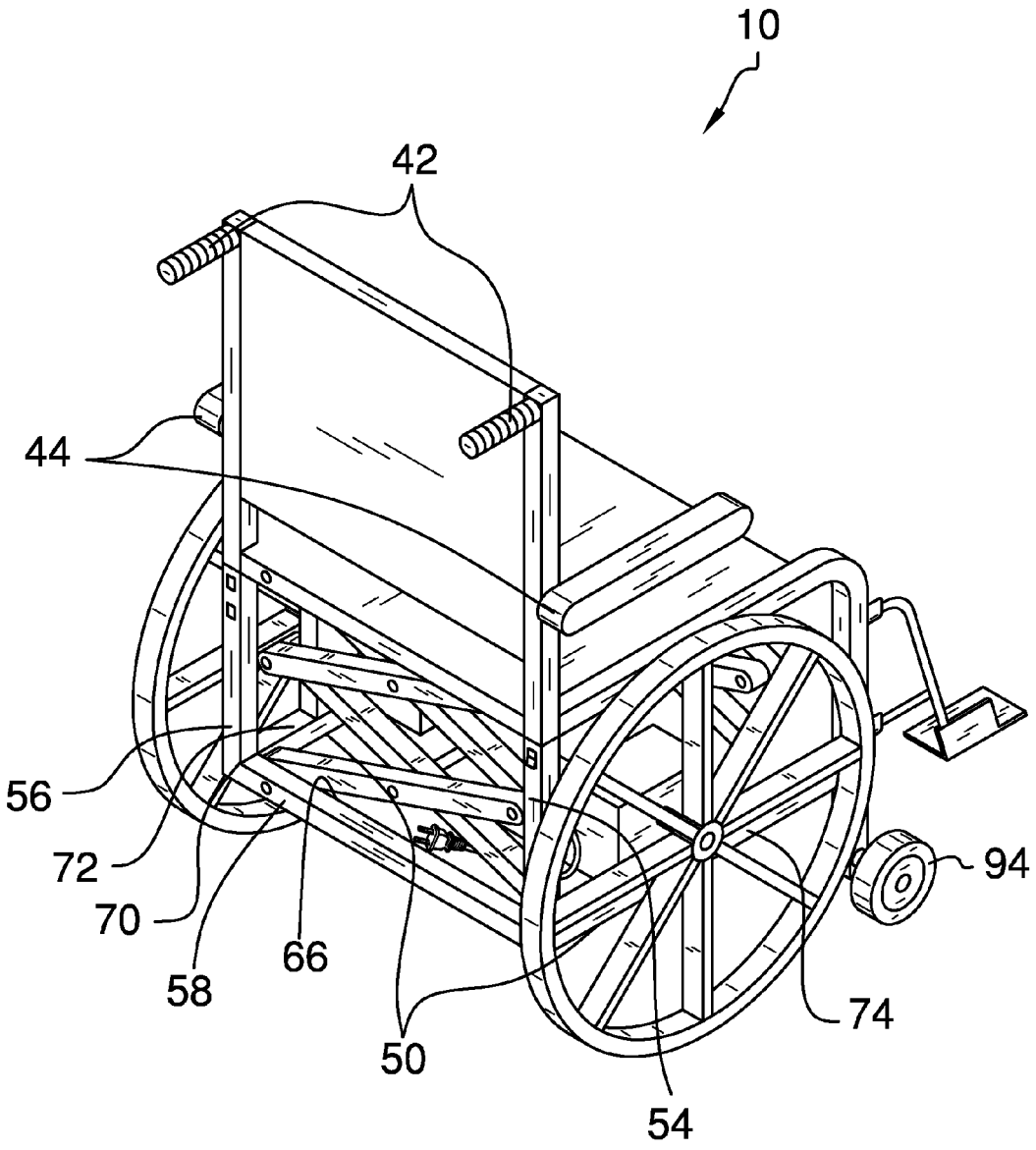
FIG. 1 is a rear isometric view.
Figure 2:
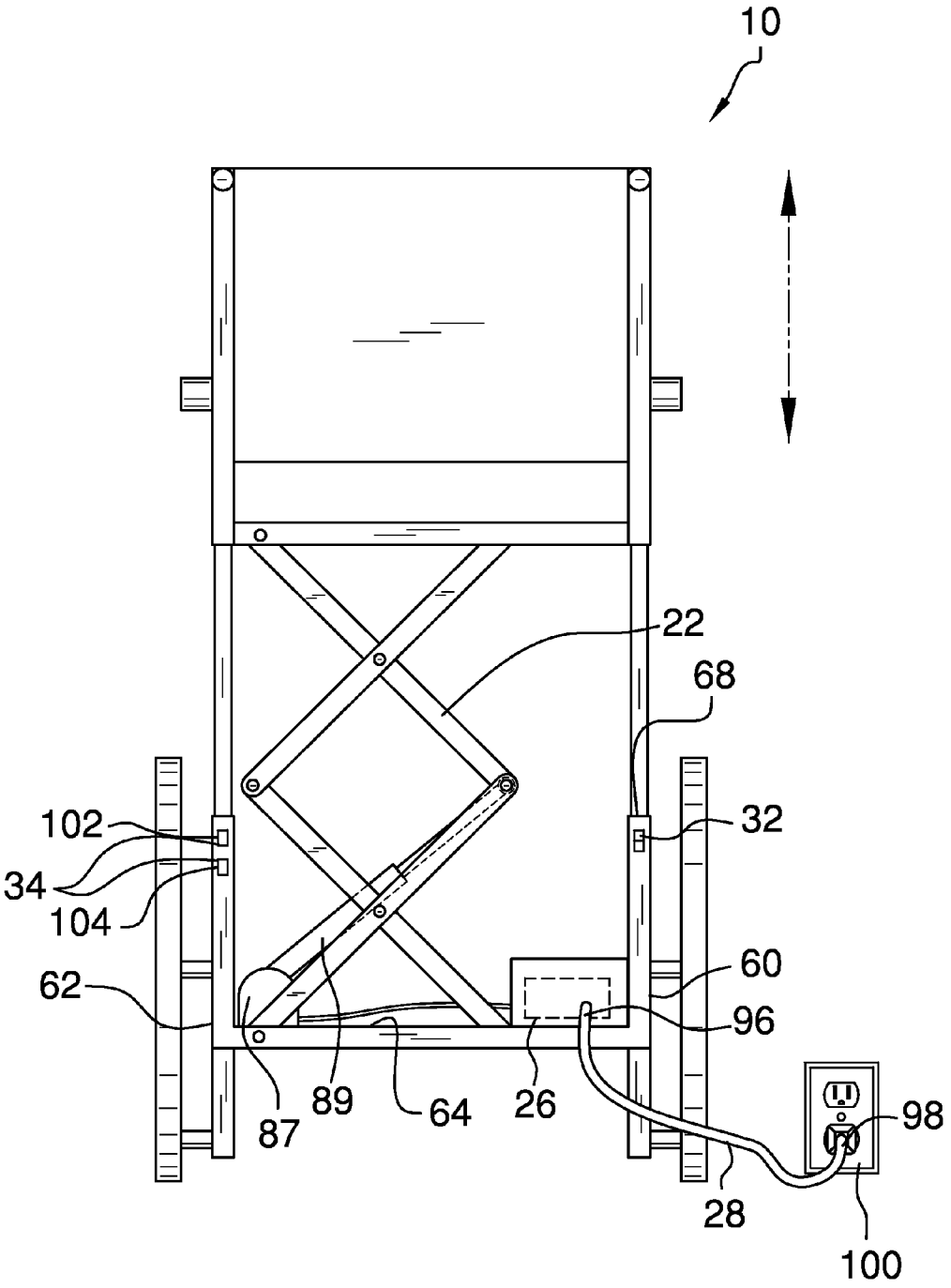
FIG. 2 is a rear elevation view showing a seat portion in an extended position.
Figure 3:
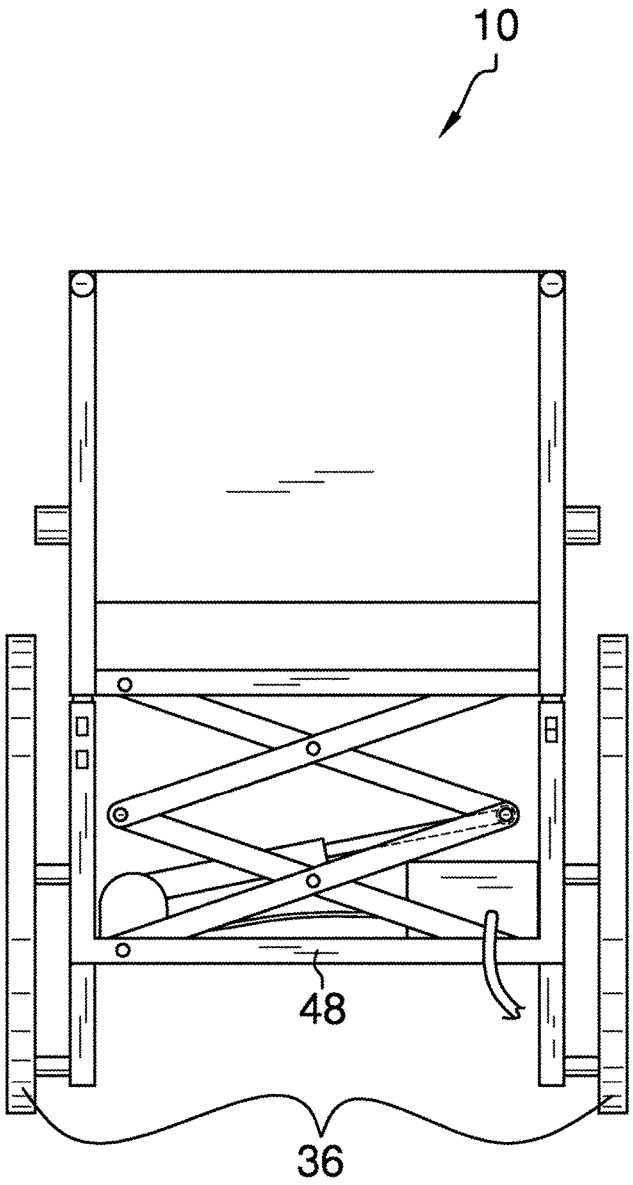
FIG. 3 is a rear elevation view showing the seat portion in a retracted position.
Figure 4:
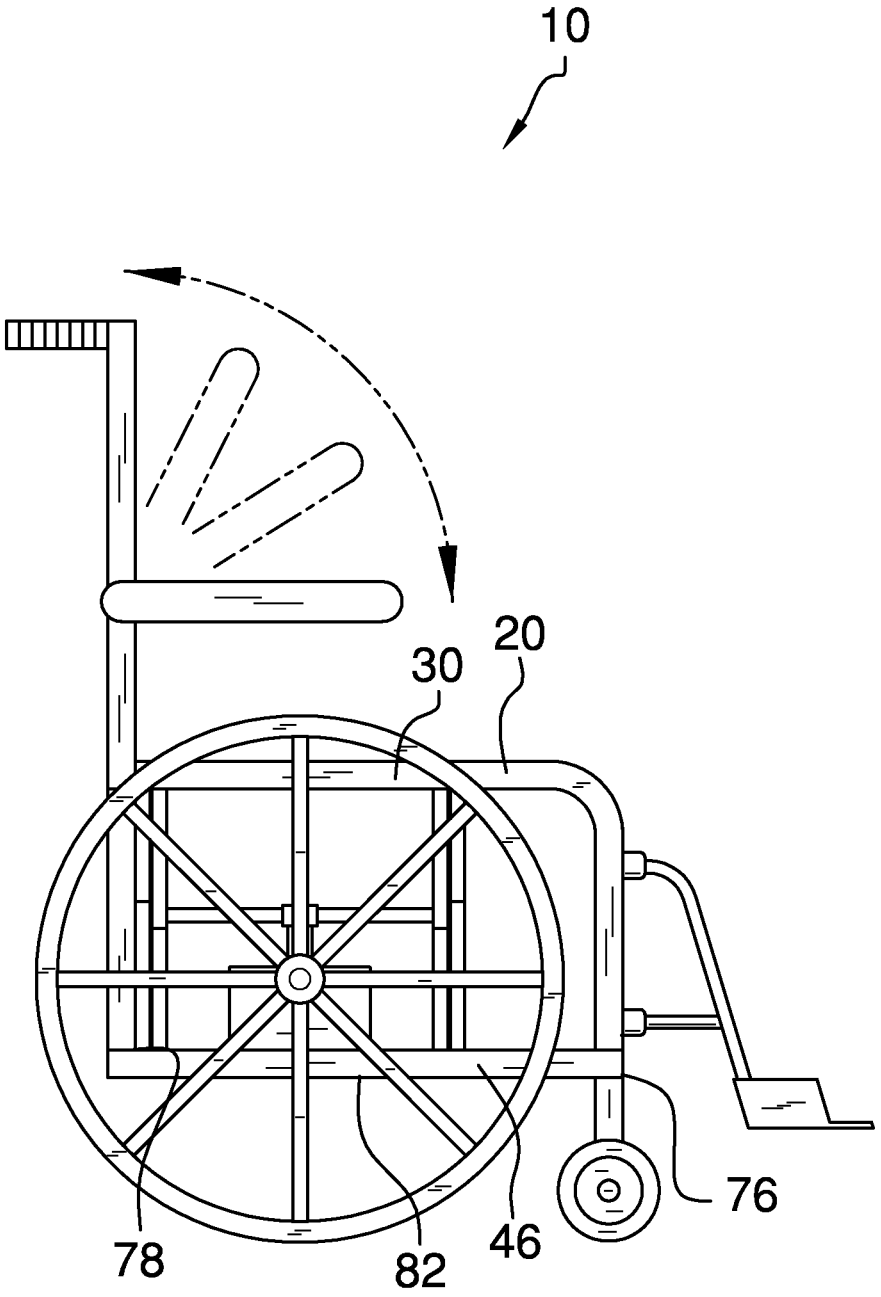
FIG. 4 is a side elevation view.
Figure 5:
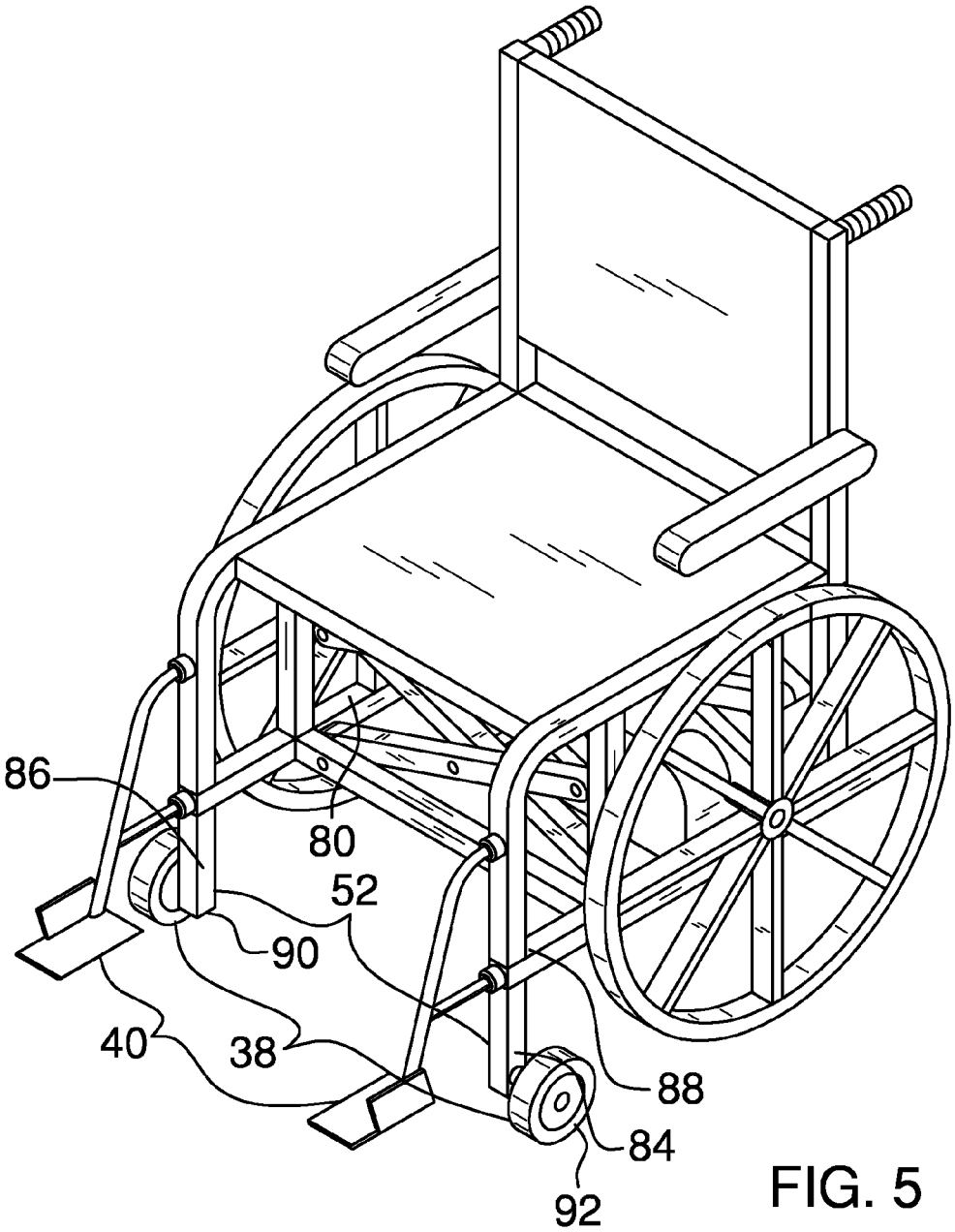
FIG. 5 is a front isometric view.

Referring to FIGS. 1 through 6 the present wheelchair with a lift assistance device 10 is illustrated. The wheelchair with a lift assistance device 10 includes a wheelchair 20, a scissor lift 22, a battery compartment 24, a rechargeable battery 26, a power cord 28, a seat portion 30, an activation control 32, and a pair of lift controls 34. The wheelchair 20 has a pair of rear wheels 36, a pair of front wheels 38, a pair of footrests 40, a pair of handles 42, a pair of armrests 44, and a support frame 46. The support frame 46 includes a continuous U-shaped rear support 48, a pair of bottom supports 50, and a pair of front vertical supports 52. As best shown in FIG. 4, the pair of armrests 44 are optionally moveable between a lowered position and an alternate raised position. Each of the pair of armrests 44 is in the lowered position when each of the pair of armrests 44 is disposed parallel to the pair of bottom supports 50. Each of the pair of armrests 44 is in the raised position when each of the pair of armrests 44 and the pair of bottom supports 50 are perpendicularly disposed.

The rear support 48 of the support frame 46 includes a right vertical support 54, a left vertical support 56, and a middle horizontal support 58. The middle horizontal support 58 has a right end 60, a left end 62, a top surface 64, and a front surface 66. Each of the right vertical support 54 and the left vertical support 56 has a top end 68 and a bottom end 70. The bottom end 70 of the right vertical support 54 is attached to the top surface 64 of the middle horizontal support 58 proximal the right end 60, and the bottom end 70 of the left vertical support 56 is attached to the top surface 64 of the middle horizontal support 58 proximal the left end 62. Each of the right vertical support 54 and the left vertical support 56 are perpendicularly disposed with the middle horizontal support 58.

The pair of bottom supports 50 of the support frame 46 includes a right bottom support 72 and a left bottom support 74. Each of the right bottom support 72 and the left bottom support 74 has a front end 76, a back end 78, a top area 80, and a bottom area 82. The back end 78 of each of the right bottom support 72 and the left bottom support 74 is attached to the front surface 66 of the middle horizontal support 58 proximal the right end 60 and the left end 62, respectively. Each of the right bottom support 72 and the left bottom support 74 are perpendicularly disposed with the middle horizontal support 58.

The pair of front vertical supports 52 of the support frame 46 includes a right front vertical support 84 and a left front vertical support 86. Each of the right front vertical support 84 and the left front vertical support 86 has a top edge 88 and a bottom edge 90. The top edge 88 of each of the right front vertical support 84 and the left front vertical support 86 is attached to the bottom area 82 of the right bottom support 72 and the left bottom support 74, respectively, proximal the front end 76. The bottom edge 90 of each of the right front vertical support 84 and the left front vertical support 86 is attached to a right front wheel 92 of the pair of front wheels 38 and a left front wheel 94 of the pair of front wheels 38, respectively. Each of the right front vertical support 84 and the left front vertical support 86 is perpendicularly disposed with the right bottom support 72 and the left bottom support 74, respectively.

The scissor lift 22 is medially disposed on the top surface 64 of the middle horizontal support 58 between the right vertical support 84 and the left vertical support 86. The battery compartment 24 is attached to the scissor lift 22. The scissor lift 22 has a motor 87 and a hydraulic arm 89. The rechargeable battery 26 is disposed within the battery compartment 24. The power cord 28 has a first end 96 and a second end 98. The first end 96 is removably attached to the rechargeable battery 26, and the second end 98 is removably attached to a power source 100.

The seat portion 30 is attached to the scissor lift 22 and removably disposed atop the support frame 46. As best shown in FIG. 2, the seat portion 30 is in the extended position when the scissor lift 22 is extended above the rear support 48 of the support frame 46. As best shown in FIG. 3, the seat portion 30 is in the retracted position when the scissor lift 22 is retracted proximal the rear support 48 of the support frame 46.

Figure 6:
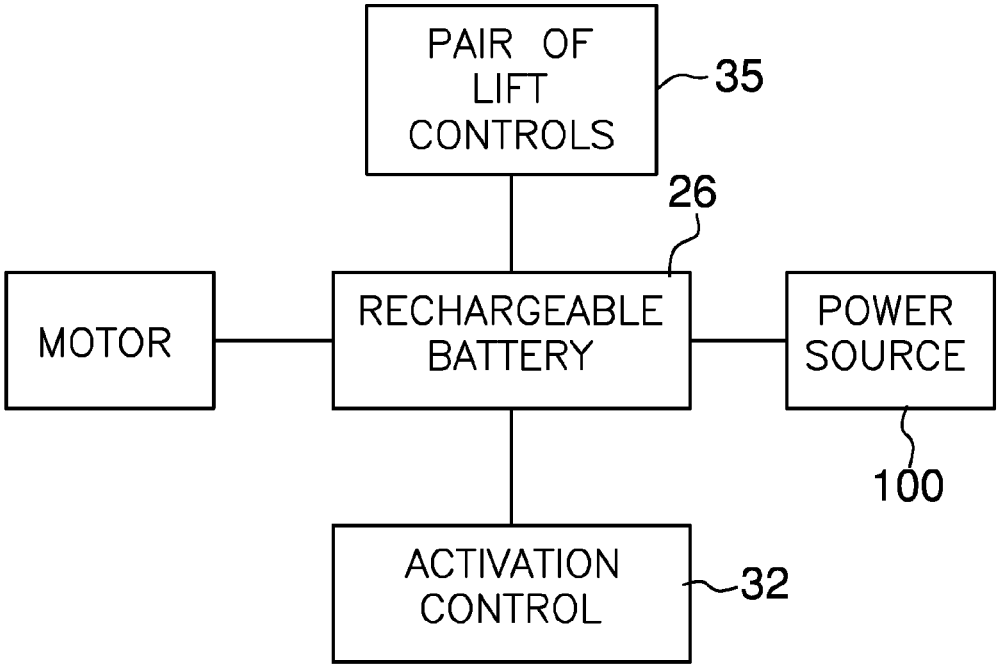
FIG. 6 is a block diagram.

The activation control 32 is disposed on the right vertical support 54. The pair of lift controls 34 includes an up control 102 and a down control 104. The pair of lift controls 34 is disposed on the left vertical support 56. As best shown in FIG. 6, the rechargeable battery 26, the power source 100, the activation control 32, and the pair of lift controls 34 are in operational communication with each other.

What is claimed is:

1. A wheelchair with a lift assistance device comprising:

a wheelchair having a pair of rear wheels, a pair of front wheels, a pair of footrests, a pair of handles, a pair of armrests, and a support frame further comprising:

a continuous U-shaped rear support comprising a right vertical support, a left vertical support, and a middle horizontal support having a right end, a left end, a top surface, and a front surface, each of the right vertical support and the left vertical support having a top end and a bottom end, wherein the bottom end of the right vertical support is attached to the top surface of the middle horizontal support proximal the right end, and the bottom end of the left vertical support is attached to the top surface of the middle horizontal support proximal the left end;

wherein the right vertical support and the middle horizontal support are perpendicularly disposed, and the left vertical support and the middle horizontal support are perpendicularly disposed;

a pair of bottom supports comprising a right bottom support and a left bottom support, each of the right bottom support and the left bottom support having a front end, a back end, a top area, and a bottom area, wherein the back end of each of the right bottom support and the left bottom support is attached to the front surface of the middle horizontal support proximal the right end and the left end, respectively;

wherein the right bottom support and the middle horizontal support are perpendicularly disposed, and the left bottom support and the middle horizontal support are perpendicularly disposed;

a pair of front vertical supports comprising a right front vertical support and a left front vertical support, each of the right front vertical support and the left front vertical support having a top edge and a bottom edge, wherein the top edge of each of the right front vertical support and the left front vertical support is attached to the bottom area of the right bottom support and the left bottom support, respectively, proximal the front end, and the bottom edge of each of the right front vertical support and the left front vertical support is attached to a right front wheel of the pair of front wheels and a left front wheel of the pair of front wheels, respectively;

wherein the right front vertical support is perpendicularly disposed with the right bottom support, and the left front vertical support is perpendicularly disposed with the left bottom support;

a scissor lift medially disposed on the top surface of the middle horizontal support between the right vertical support and the left vertical support, the scissor lift having a motor and a hydraulic arm;

wherein the hydraulic arm is configured to move the scissor lift between an extended position and an alternate retracted position;

a battery compartment attached to the scissor lift;

a rechargeable battery disposed within the battery compartment;

a power cord having a first end and a second end, wherein the first end is removably attached to the rechargeable battery, and the second end is removably attached to a power source;

a seat portion attached to the scissor lift, the seat portion removably disposed atop the support frame;

wherein the scissor lift is configured to move the seat portion from an elevated position to an alternate lowered position;

wherein the seat portion is in the elevated position when the scissor lift is extended above the rear support of the support frame;

wherein the seat portion is in the lowered position when the scissor lift is retracted proximal the rear support of the support frame;

an activation control disposed on the right vertical support, wherein the activation control is configured to activate the scissor lift; and a pair of lift controls disposed on the left vertical support, the pair of lift controls comprising an up control and a down control, wherein the up control is configured to activate the scissor lift to raise the seat portion to the extended position, and the down control is configured to activate the scissor lift to lower the seat portion to the retracted position;

wherein the motor, the rechargeable battery, the power source, the activation control, and the pair of lift controls are in operational communication with each other.

2. The wheelchair with a lift assistance device of claim 1 wherein each of the pair of armrests are moveable between a lowered position and an alternate raised position, wherein each of the pair of armrests of the wheelchair is in the lowered position when each of the pair of armrests of the wheelchair is disposed parallel to the pair of bottom supports, and each of the pair of armrests of the wheelchair is in the raised position when each of the pair of armrests of the wheelchair and the pair of bottom supports are perpendicularly disposed.

* * * * *